US005628698A

United States Patent [19]

Sumitomo

[11] Patent Number: 5,628,698

[45] Date of Patent: May 13, 1997

[54] IRON CLUB HEAD

[75] Inventor: Norio Sumitomo, Akashi, Japan

[73] Assignee: Sumitomo Rubber Industries, Ltd., Kobe, Japan

[21] Appl. No.: 500,661

[22] Filed: Jul. 11, 1995

[30] Foreign Application Priority Data

Jul. 14, 1994 [JP] Japan ..... 6-186230

[51] Int. Cl.[6] ..... A63B 53/04

[52] U.S. Cl. ..... 473/341; 473/349

[58] Field of Search ..... 273/167 R, 167 F, 273/169, 77 R, 77 A, 171, 173; 473/290, 291, 324, 334, 341, 349, 350

[56] References Cited

U.S. PATENT DOCUMENTS 3,059,926 10/1962 Johnstone ..... 273/167 R 4,826,172 5/1989 Antoniuous ..... 273/167 H 4,921,252 5/1990 Antonious ..... 273/169

5,011,151 4/1991 Antonious ..... 273/169

5,263,718 11/1993 Solheim ..... 273/167 F

FOREIGN PATENT DOCUMENTS 2194737 3/1988 United Kingdom ..... 273/77 A

OTHER PUBLICATIONS

"Golf World" magazine, Jun. 13, 1972 issue, p. 25.

*Primary Examiner*—Sebastiano Passaniti

*Attorney, Agent, or Firm*—Armstrong, Westerman, Hattori, McLeland & Naughton

[57] ABSTRACT

The invention relates to an iron club head. The face thereof is equally divided into four sections. The weight of the outermost section of the toe side among the four sections is arranged to be 35%–60% of the overall weight of the head.

3 Claims, 1 Drawing Sheet

IRON CLUB HEAD

BACKGROUND AND SUMMARY OF THE INVENTION

The present invention relates to an iron club head.

Conventionally, attempts to increase moment of inertia in a golf club head have been made.

This is because when the moment of inertia is increased, a twisting action of the club head against an impact on the head at striking a ball is decreased, and consequently this improves directional stability of the ball, which is important as a function of a golf club, and also improves elasticity when the ball is struck at any position on the face.

The moment of inertia has been conventionally increased by applying weighting around the perimeter of the back portion such as the toe, heel, upper portion, and lower portion of the head, or arranging the head to be hollow in order to distribute the weight around the perimeter and increase the volume of the head.

Generally, a golf club is provided with a neck portion for connecting the head with the shaft, however, mass of the neck portion has not been positively utilized efficiently in a conventional golf club.

In order to effectively further increase moment of inertia in the toe-heel direction (about the vertical axis), I conducted enormous experiments, investigation, and examination, with trial and error, and I found out that said moment of inertia is effectively increased by adding mass corresponding to the mass of the neck portion to the toe portion of the iron club head, and thereby achieved the present invention.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

The iron club head 1 according to the present invention is arranged so that the face 6 is divided into four sections A, B, C, and D at right angles to the longitudinal direction and that the outermost section A at the toe 4 side is extremely heavy.

That is to say, the weight of the outermost section A is arranged to be 35%–60%, and preferably 40%–50%, of the overall weight of the head.

Specifically, most of the weight that exists at each portion of the backside (the reverse face of the face 6) is concentrated at the toe 4 side, and consequently the percentage of the weight of the outermost section A is arranged to be 35%–60%, and preferably 40%–50%. In other words, an iron club head which is traditionally called "a cavity-back iron" wherein perimeter weighting portion which has existed around the perimeter of the backside is concentrated at the toe 4 side.

Figure 1:
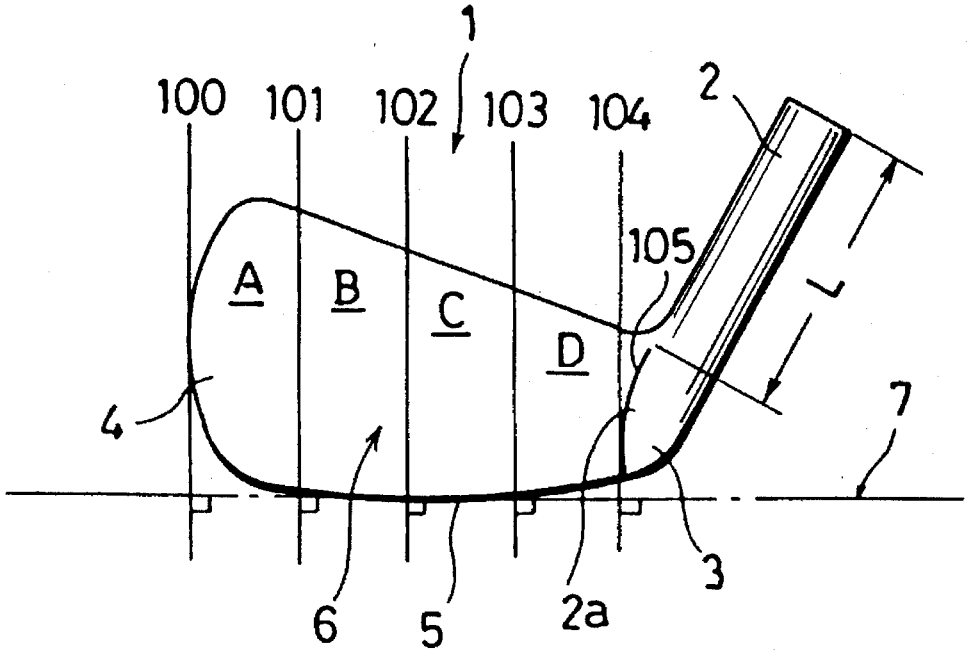
FIG. 1 is an explanatory view of the construction of the present invention.

A method of equally dividing the face 6 into four sections A, B, C, and D is going to be explained with reference to FIG. 1. 7 is a horizontal line indicating the face contacting the ground, and parallel straight lines 100, 101, 102, 103, and 104 are successively drawn from an end of the toe 4 side to the heel 3 side. These straight lines 100, 101, 102, 103, and 104 are perpendicular with the horizontal line 7, and the outermost straight line 100 touches the outermost end of the face 6, and the innermost straight line 104 touches the boundary 105 between the face 6 and a thick portion 2*a* that continues to the neck portion 2.

The respective distances between 100 and 101, 101 and 102, 102 and 103, and 103 and 104 are arranged to be equal, and thereby the four sections A, B, C, and D are assumed.

Next, iron club heads according to the present invention and iron club heads for comparison (a), (b), and (c) (however, the comparative example (c) proved to be hard to manufacture from the viewpoint of structure and strength of the head) were actually manufactured, and Table 1 shows the results of a survey on each moment of inertia. The iron club heads according to the present invention and those for comparison are (what is called) cavity-back type, in which projections are partially formed on the backsides in order to increase weight distribution to their perimeters. They were manufactured by appropriately changing weight distribution to these projections, and each overall weight of the respective heads is 260 g, and each weight of the respective neck portions is 55 g.

TABLE 1

| Section | A | | B | | C | | D | | Moment of Inertia Mz about vertical axis | Moment of Inertia Mx about horizontal axis |
|---|---|---|---|---|---|---|---|---|---|---|
| Weight · Ratio to Head | g | % | g | % | g | % | g | % | g · cm² | g · cm² |
| Present Invention ① | 96 | 37 | 33 | 12.5 | 39 | 14.8 | 37 | 14.4 | 3320 | 665 |
| Present Invention ② | 108 | 41.5 | 30 | 11.5 | 36 | 13.8 | 31 | 11.9 | 3465 | 670 |
| Present Invention ③ | 125 | 48 | 27 | 10.5 | 28 | 10.7 | 25 | 9.5 | 3584 | 673 |
| Present Invention ④ | 146 | 56 | 22 | 8.5 | 23 | 8.8 | 14 | 5.4 | 3725 | 688 |
| Comparative Example (a) | 75 | 28.8 | 63 | 24.2 | 36 | 13.8 | 31 | 11.9 | 2954 | 670 |
| Comparative Example (b) | 78 | 30 | 32 | 12.3 | 45 | 17.3 | 49 | 18.8 | 3020 | 669 |
| Comparative Example (c) | 169 | 65 | Hardly manufactured because of the structure and strength of the head | | | | | | | |

Overall Weight of Each Head = 260 g; Weight of Each Neck Portion = 55 g; Each No. 5 Iron FIG. 1 illustrates an iron club head according to the present invention, and the head continuously possesses a neck portion 2 having a length L of 20 mm–70 mm. 3 indicates a heel, 4 a toe, 5 a sole, and 6 a face for striking a golf ball.

Figure 2:
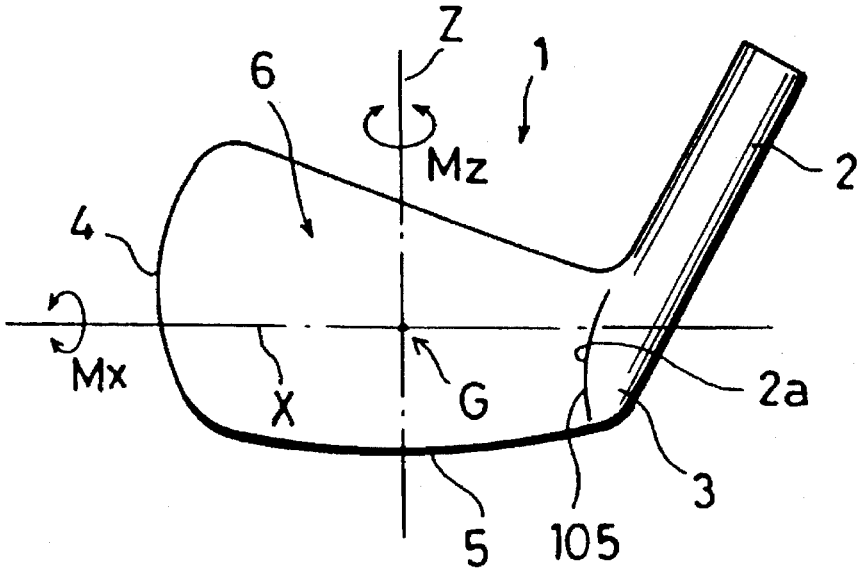
FIG. 2 is an explanatory view of moment of inertia.

Moment of inertia Mz about vertical axis in Table 1 indicates the moment of inertia about a vertical axis Z which passes the center of gravity G in the head as shown in FIG. 2, and moment of inertia Mx about horizontal axis indicates the moment of inertia about a horizontal axis X which passes the center of gravity G in the head in its back and forth direction.

It is obvious from Table 1 that the moment of inertia Mz about the vertical axis Z increases when the weight of the outermost section A is 35%–60% of the overall weight of the head, and that it is particularly preferable to arrange the percentage within the range of 40%–50%. That is to say, when the percentage is less than these ranges, the sweet spot area increases little because the vertical moment of inertia Mz increases less, and when the percentage is above these ranges, strength of the other sections B, C, and D is insufficient and this causes trouble in striking a ball and inferiority in feel and the distance of the ball's flight.

By way of parenthesis, the moment of inertia about a vertical axis of an iron head (No. 5 iron) presently on the market is approximately 3000 $g.cm^2$ at most.

According to the present invention, it is possible to ingeniously utilize the weight of the neck portion 2 itself for connecting with the shaft in order to increase the moment of inertia Mz about the vertical axis of the head. That is to say, said weight of the neck portion 2 itself and the weight of the outermost section A where weight has been additionally concentrated were balanced and the moment of inertia Mz about the vertical axis increased synergistically.

In other words, the present invention enables a conventional iron with a neck portion to exceed the limit of the moment of inertia about a vertical axis.

Therefore, an iron club head according to the present invention increases sweet spot and decreases the deviation or swerve of direction of flight from the objective direction when miss-hit or when the ball slices or hooks. Ball orientability is thus improved. Moreover, it is possible to considerably diminish the decrease in initial velocity of the ball when miss-hit.

While preferred embodiments of the present invention have been described in this specification, it is to be understood that the invention is illustrative and not restrictive, because various changes are possible within the spirit and indispensable features.

I claim:

1. An iron club head having an inner most neck portion, an outermost toe portion and a face portion therebetween wherein the weight of the outermost toe portion among four sections obtained by equally dividing the toe portion and face portion at right angles to the longitudinal direction of said club head is 35%–60% of the overall weight of the head.

2. An iron club head having an inner most neck portion, a face and a toe side having an outermost section wherein the weight of the outermost section at the toe side among four section obtained by equally dividing the face of said club head with said toe portion at right angles to the longitudinal direction of said club head is 40% to 50% of the overall weight of the club head.

3. The iron club head as set forth in claim 1 or 2, wherein the length of the neck portion is arranged to be 20 mm–70 mm.

* * * * *